US007882984B2

(12) United States Patent
Francois et al.

(10) Patent No.: US 7,882,984 B2
(45) Date of Patent: Feb. 8, 2011

(54) FLUID OR PASTY PRODUCT DISPENSING DEVICE

(75) Inventors: Cedric Francois, Paris (FR); Laurent Fontaine, Paris (FR)

(73) Assignee: Nouvel Oeuvre, Paris (FR)

( * ) Notice: Subject to any disclaimer, the term of this patent is extended or adjusted under 35 U.S.C. 154(b) by 747 days.

(21) Appl. No.: 11/721,514

(22) PCT Filed: Dec. 14, 2005

(86) PCT No.: PCT/FR2005/003134

§ 371 (c)(1),
(2), (4) Date: Sep. 5, 2007

(87) PCT Pub. No.: WO2006/064128

PCT Pub. Date: Jun. 22, 2006

(65) Prior Publication Data

US 2009/0188942 A1 Jul. 30, 2009

(51) Int. Cl.
*B65D 83/16* (2006.01)
*B65D 83/22* (2006.01)
*B05B 11/00* (2006.01)

(52) U.S. Cl. ..... 222/153.13; 222/153.14; 222/384; 222/402.11

(58) Field of Classification Search ..... 222/153.13, 222/153.14, 384, 402.11
See application file for complete search history.

(56) References Cited

U.S. PATENT DOCUMENTS

| | | | | | |
|---|---|---|---|---|---|
| 2,752,066 | A | * | 6/1956 | Ayres | 222/402.11 |
| 3,050,219 | A | * | 8/1962 | Sagarin et al. | 222/402.11 |
| 3,062,411 | A | * | 11/1962 | Miles | 222/402.11 |
| 3,460,719 | A | * | 8/1969 | O'Donnell et al. | 222/402.11 |
| 3,474,939 | A | * | 10/1969 | O'Donnell et al. | 222/402.11 |
| 3,632,024 | A | * | 1/1972 | Usen | 222/402.11 |
| 3,790,034 | A | * | 2/1974 | Horvath | 222/153.13 |
| 5,070,611 | A | * | 12/1991 | Derin et al. | 222/402.11 |
| 5,388,730 | A | * | 2/1995 | Abbott et al. | 222/153.13 |
| 5,957,337 | A | * | 9/1999 | Bettison, Jr. | 222/402.11 |

FOREIGN PATENT DOCUMENTS

GB 2238088 A * 5/1991

* cited by examiner

*Primary Examiner*—Kenneth Bomberg
(74) *Attorney, Agent, or Firm*—MWV Intellectual Property Group

(57) ABSTRACT

A device for dispensing a fluid or pasty product includes a dispensing member fixed to a container including a neck and a cap, about the dispensing member, wherein the neck includes a ramp and an edge of the cap includes a ramp, the ramps being mutually mobile in rotation between a dispensing position wherein the dispensing member can be actuated and a locking position wherein the ramps prevent the dispensing member from being actuated.

9 Claims, 3 Drawing Sheets

FLUID OR PASTY PRODUCT DISPENSING DEVICE

CROSS-REFERENCE TO RELATED APPLICATIONS

This application claims the benefit of PCT Application PCT/FR2005/003134 entitled "Dispositif de distribution," filed Dec. 14, 2005 and published as WO2006/064128, which claims the benefit of French Application No. 04.13329, entitled "Dispositif de distribution" filed Dec. 15, 2004, now French Patent No. 2879173, and incorporates each of these applications herein by reference in their entirety.

BACKGROUND OF THE INVENTION

1. Field of the Invention

The purpose of this invention is a device for dispensing a fluid or pasty product, including a locking system.

2. State of the Art

Dispensing devices are frequently used in the perfume, cosmetics or even pharmaceutical industries to dispense fluid or pasty products by manually pressing the push-button with a finger. For safety reasons, it is desirable to be able to lock the dispensing member is a closed position to prevent undesired actuation of the valve or pump. In general, a removable cap enables protecting the push-button when the dispenser is not in use, but such caps are easily removed and therefore not reliable protection for the sprayer. It is therefore desirable for users to have an effective lock, which is not separable from the dispensing device, making it possible to lock the device when it is not used, for example during transport.

Spray devices including a locking system are known through document FR2803543. The spray device described by this document also includes a horizontal-sliding collar surrounding the neck of the container and able to have two positions, dispensing and locking, respectively, in which it allows or prohibits the motion of pushing in the push-button. The collar consists of a pull tab with two opposed horizontal strips able to slide into the openings of a set surrounding the pump. Said collar is located between the container and the push-button. The collar includes two cylindrical vertical walls capable of coming straight from the push-button in order to impede its translation. When the collar is in locked position, the lower part of the vertical wall of the push-button rests on the upper part of the walls of the collar, which impedes the translation of said push-button toward the container, therefore the actuation of the pump. When the collar is in the dispensing position, the walls of the collar move laterally compared with the wall of the push-button and therefore permit its actuation.

Another solution is known through document FR2589756. The push-button is equipped with two pressure wings diagonally opposite the nozzle. Between the push-button and the container, two axial arms are provided diagonally opposite the periphery of the container, so that the descent of the wings from the nozzle, therefore the actuation of the pump, is possible in an adapted position of said push-button and is impeded when the push-button is turned 90°.

However, the means provided for locking the push-button in the dispensing devices described in these two documents are relatively complex and require the use of additional, expensive pieces, which are complicated to produce from the manufacturing perspective.

BRIEF DESCRIPTION OF THE DRAWINGS

The invention will be best understood, and other purposes, details, characteristics and advantages of it will appear more clearly during the following detailed explanatory description of several methods of realizing the invention provided as purely illustrative and unlimited examples, in reference to the attached diagram drawings. On these drawings.

DETAILED DESCRIPTION OF EMBODIMENTS OF THE INVENTION

Figure 1:
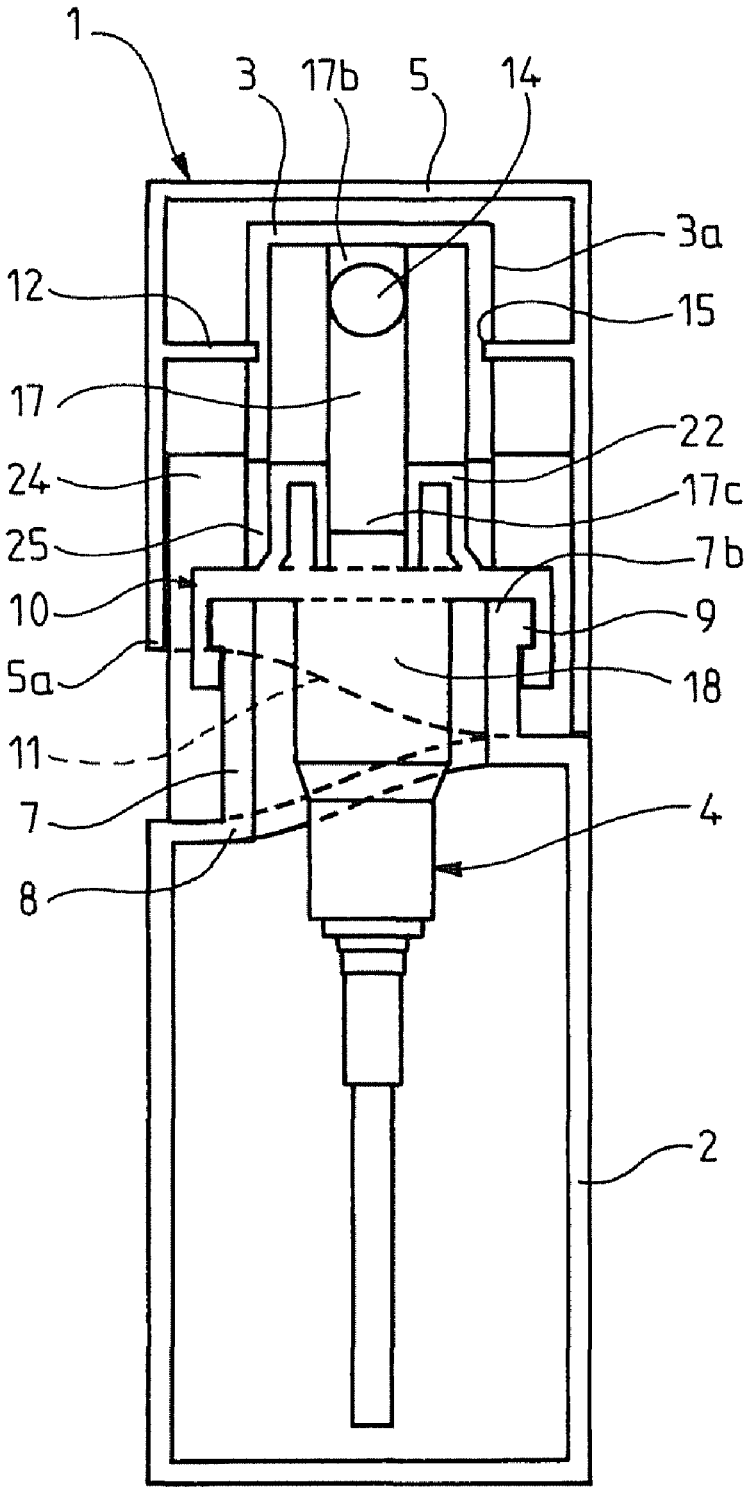
FIG. 1 is a simplified front and cross section view of the spray device according to the invention, with the device in the locked position.

The purpose of this invention is to propose a new dispensing device that avoids the above-referenced drawbacks, in which the locking system that enables locking the pump is simpler and does not require the use of additional pieces compared with a traditional dispensing device.

For this reason, the purpose of the invention is a fluid or pasty product dispensing device including a dispensing member attached to a container with a sealing ring, with said dispensing member having mounted thereon a push-button capable of being depressed to operate said dispensing device, with said push-button including a dispensing orifice permitting the product ejection when said dispensing member is operated, and a cap, integral with said push-button upon translation about the median axis of the dispensing device toward said container, characterized by the fact that said cap and said container each include a ramp, with said ramps being mobile, in rotation with each other between a dispensing position in which the dispensing member can be actuated and a locked position in which they impede the actuation of said dispensing member.

Favorably, said ramps have a complementary shape.

Preferably, said ramps have a sinusoidal shape.

According to one characteristic of the invention, said cap and said push-button are integral in translation.

According to another characteristic of the invention, said cap includes an interior-projecting ring and said push-button includes an annular groove, the interior radial edge of said ring resting in said annular groove.

Favorably, said dispensing device includes a centering ring, with said centering ring capable of cooperating with said push-button to guide it, in cooperation with the sealing ring during translation, about the median axis of the dispensing device, of said push-button.

According to another characteristic of the invention, said centering ring is capable of cooperating with said cap to guide it during translation about the median axis of the dispensing device.

Preferably, said centering ring is capable of cooperating with said cap to limit, in cooperation with said projecting ring, the translation of the cap toward the container.

Favorably, the lower edge of said centering ring has the noticeable shape of the ramp of the container and the upper edge of said centering ring has a circular section orthogonal to the median axis of the dispensing device.

According to one method of realizing the invention, the centering ring and the sealing ring are comprised of a single piece.

The dispensing device according to this invention can be, for example, a sprayer. However, the dispensing device can be adapted to permit the dispensation of a fluid or pasty product in any form, for example in the form of a drop, jet or dollop of product.

According to a specific method of realizing the invention, with a view to spraying, said dispensing device includes a discharge tube to connect said dispensing member and said dispensing orifice, with said discharge tube including at least three channels converging in an intersection point, with said intersection point located upstream of said dispensing orifice.

According to another method of realizing the invention, with a view to delivering the product in the form of drop, said dispensing device includes a discharge tube to connect said dispensing member and said dispensing orifice, with said discharge tube containing a single channel.

Referring to FIG. 1, a spray device is seen, including the traditional bottle shape 1, a container 2, a push-button 3, a dispensing member 4 and a cap 5.

The container 2 is intended to contain a fluid product such as perfume, water or a pharmaceutical product. The container 2 has a perceptibly cylindrical shape. The container 2 includes a neck 7. The lower edge of the neck 7 follows a ramp 8.

The ramp 8 is such that the height of the neck 7 is not constant on its circumference. The width of the ramp 8 is roughly equal to the difference between the radius of the container 2 and the radius of the neck 7.

The end 7*b* of the neck 7 includes a radial exterior-projecting ring 9. Said ring 9 is capable of cooperating with a sealing ring 10 as described in detail later. The end 7*b* includes an opening 7*c* to insert the dispensing member 4 in the container 2.

The cap 5 has a roughly cylindrical shape. The lower end 5*a* of the cap 5 defines an orifice with a diameter greater than the diameter of the neck 7 so that the cap 5 is capable of fitting on said neck 7. In the realization example shown, the cap 5 has a diameter roughly equal to the diameter of the container 2. The cap 5 has a ramp 11 on its lower edge.

Figure 4:
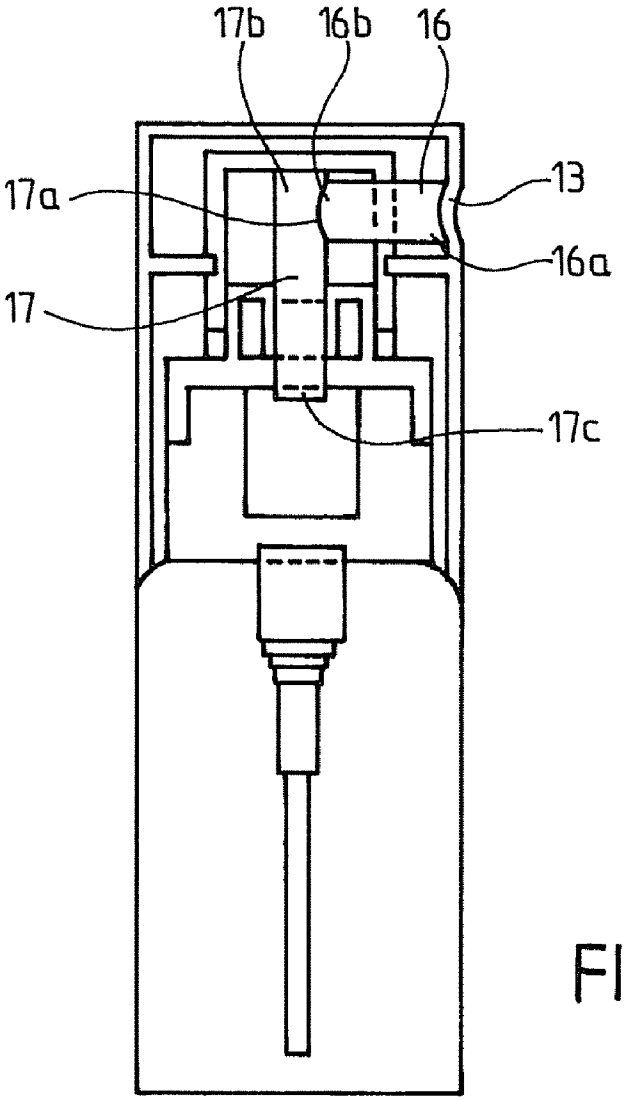
FIG. 4 is a simplified side and cross section view of the spray device, with the device in locked position.

The cap 5 has an interior-projecting ring 12. The cap 5 includes an opening 13 (FIG. 4), in a circular shape for example, and said opening 13 is capable of cooperating with the push-button 3 to permit dispensing a fluid product as will be described in detail later.

The push-button 3 has a perceptibly cylindrical shape and traditionally includes a dispensing orifice 14, with a circular section for example. The exterior radial area 3*a* of the push-button 3 has an annular groove 15. Said groove 15 cooperates with the ring 12 so that the interior radial edge of the ring 12 fits into the groove 15. The connection between the groove 15 and the ring 12 is such that the cap 5 and the push-button 3 are integral in translation and the cap 5 can turn in relation to the push-button 3 along axis A, which is the median axis of the spray device. A rotation of axis A of the cap 5 relative to the push-button 3 leads to a rotation of axis A in the same direction and same angle of the cap 5 relative to the container 2.

The ramps 8 and 11 are capable of coming in contact on a portion of their length (FIG. 1) when the cap 5 is in an adapted angular position relative to the container 2, with the cap 5 in a normal position, i.e., it is not pressed toward the container 2, as will be described in detail later. The ramps 8 and 11 are capable of defining between them and on their entire length a space sufficient (FIG. 2) to permit the actuation of the dispensing member 4 when the cap 5 is in an adapted angular position relative to the container 2, with the cap 5 in a normal position, as will be described in detail later. For example, said ramp 11 has a shape complementary to ramp 8 so that the two ramps 8 and 11 are capable of coming into contact on their entire length.

A hollow shaft 16 (FIG. 4), which is provided perpendicular to axis A, crosses the dispensing orifice 14. Said shaft has a diameter equal to the diameter of the orifice 14 and is rigidly attached to the orifice 14. Said shaft 16 has a length such that one of the ends 16*a* of the shaft is in contact with the opening 13 and the other end 16*b* of the shaft 16 is attached to a discharge tube 17, which is placed vertical to the center of the bottle 1.

Said tube 17 has, for example, a diameter roughly equal to the diameter of the shaft 16 and includes an orifice 17*a* on the end 16*b*. The end 17*b* of the tube 17 is rigidly attached to the push-button 3. The other end 17*c* of the tube 17 is inserted into the dispensing member 4. The tube 17 can for example include three channels, which converge at an intersection point. The intersection point is located in the tube 17, near the dispensing orifice 14 for example. When a dose of product is ejected by the dispensing member 4 and it arrives via the three channels at the intersection point, an eruption of the particles occurs, which permits the spraying of the product.

The dispensing member 4, which is a pump or valve here, includes a pump body 18, which is placed in the container 2. Traditionally, the pump 4 includes a piston (not shown), which is capable of sliding into the pump body 18.

The ring 10 ensures good sealing of the device. Another purpose of the ring 10 is to hold the dispensing member 4 and attach it in the opening of the container 2. It is a traditional fixing ring. The ring 10 is for example set on the neck 7. When the ring 10 is set, the ring 9 impedes a vertical translation toward the top of the ring 10 relative to the container 2. The ring 10 includes a sleeve 22 whose lower edge is placed in the interior periphery of the ring 10. The sleeve 22 is engaged with friction on the tube 17. The sleeve also permits guiding the tube 17 during a translation of the tube 17 about the axis A. The height of the sleeve 22 is such that the upper edge of the sleeve 22 is roughly level with the lower edge of the push-button 3 when the push-button is in normal position, i.e., when no pressure is exerted on it. The exterior diameter of the sleeve 22 is such that the sleeve 22 is capable of being inserted with friction in the skirt of the push-button 3. The sleeve 22 also makes it possible to ensure guiding of the push-button 3 during a vertical translation of the push-button 3 relative to the container 2.

The sprayer contains a centering ring 24. The ring 24 is capable of guiding the push-button 3, in cooperation with the ring 10 during vertical translation. The ring 24 is capable of guiding the cap 5 during vertical translation. The ring 24 is capable of limiting the vertical translation of the cap in the direction of the container 2 in cooperation with the ring 12. The ring 24 has the shape of a sleeve and is inserted on the fixing ring 10 and on the neck 7. The ring 24 is integral to the ring 10 and the neck 7. The lower edge of the ring 24 follows the ramp 8. The upper edge of the ring is orthogonal to the axis A and is roughly located at the height of the lower edge of the push-button 3, when the push-button 3 is in normal position. The interior diameter of the ring 24 is not constant, such that the interior surface of the ring 24 is, on its interior portion, resting on the neck 7, on its central portion, resting on the ring 10 and on its upper portion there is a space 25 between the ring 24 and the sleeve 22. The space 25 between the ring 24 and the sleeve 22 has the shape of a well, the width of which is such that the push-button 3 is capable of sliding between the ring 24 and the sleeve 22, for example during a dispensing operation. The exterior diameter of the ring 24 is constant and such that the cap 5 can slide on the ring 24 with friction.

Figure 2:
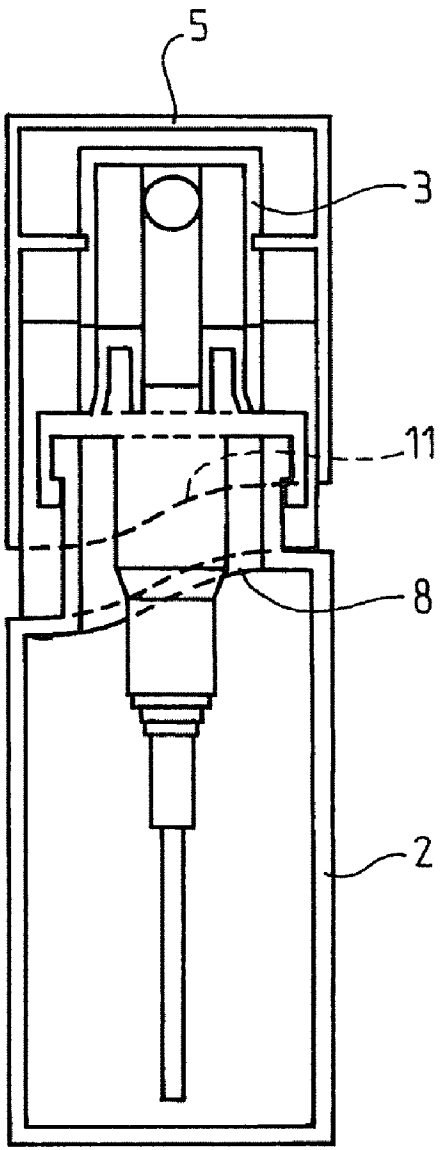
FIG. 2 is a view analogous to FIG. 1, with the device in dispensing position.

Now, we will describe the operation of the sprayer according to the invention, by beginning with a dispensing status of said sprayer, which is represented in FIG. 2 and in which the ramps 8 and 11 are not in contact with each other.

Figure 3:
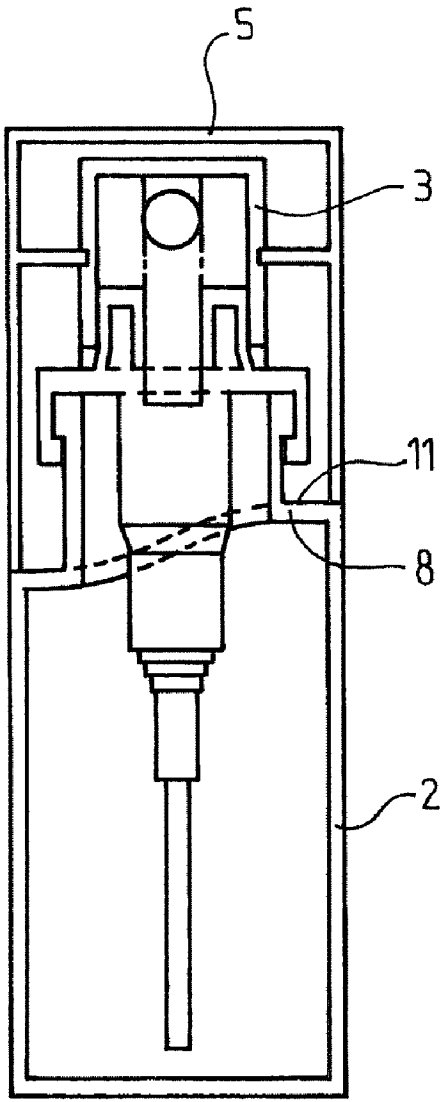
FIG. 3 is a view analogous to FIG. 2, with the push-button pressed.

In this state, when the user presses on the cap 5 so that said cap 5 translates vertically toward the container 2, the ring 12, which is inserted in the groove 15 drives the push-button 3, which translates in the same direction. The maximum translation that the cap 5 can realize relative to the container 2 corresponds to the difference between the ramps 8 and 11 in normal position of the cap 5. The status corresponding to the two ramps 8 and 11 in contact is shown in FIG. 3. This status corresponds to a status in which the ring 12 is resting on the upper edge of the ring 24. The difference between the ramps 8 and 11 in normal position of the cap 5, which also corresponds to the difference between the ring 12 and the upper edge of the ring 24 in normal position of the cap 5, can for example, correspond to the path of the piston. The effect of this translation is to depress the tube 17 into the body of the pump 18. The translation of the tube 17 actuates the pump 4, which has the effect of forcing a dose of the product back through the tube 17 up to the dispensing orifice 14 then up to the opening 13 in the traditional manner.

Now, we will describe a locking operation of the spray device according to the invention.

When beginning with the dispensing status shown in FIG. 2, a user works on the cap 5 so that said cap 5 executes a rotation of axis A and 180° relative to container 2, with the ramps 8 and 11 placed in such a manner that they are in contact on one part of their length, in normal position of the cap 5. The device is in locked position. This position is shown in FIG. 1 and in FIG. 4.

When a user attempts, in this position, to press on the cap 5, the contact between the ramps 8 and 11 impedes the translation of said cap 5 and therefore of said push-button 3 and the pump 4 cannot therefore be actuated. When, beginning from the locked status, a user carries out the same operation, i.e., a 180° rotation of the cap 5 relative to the container 2, the ramps 8 and 11 are again mobile in translation one compared with the other. The system is in dispensing position.

Figure 5:
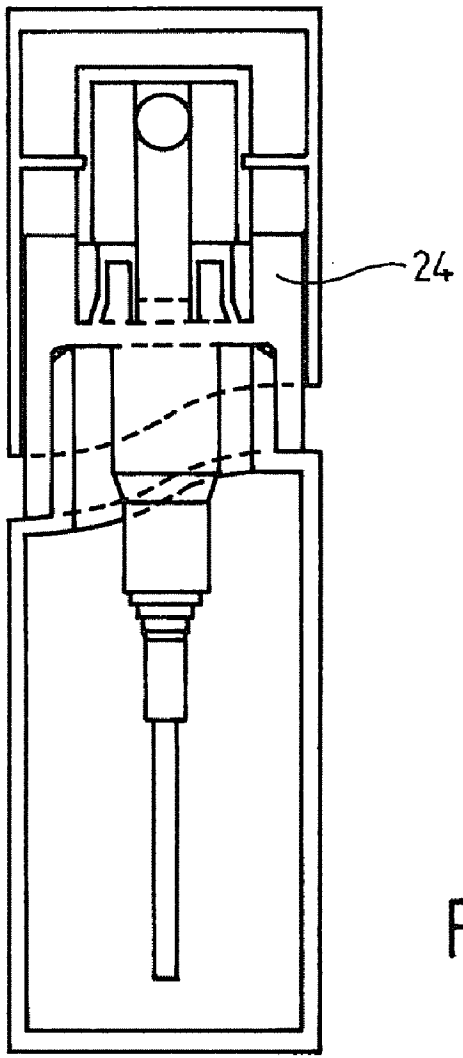
FIG. 5 is a view analogous to FIG. 1, but showing a variation of the spray device according to the invention.

Referring to FIG. 5 shows a variation for realizing the sprayer according to the invention. The centering ring and the sealing ring are comprised of a single piece 124. The single piece 124 is obtained for example by molding.

Other variations of the spray device, not shown, are possible.

For example, the ramps 8 and 11 can be a complementary and oval shape, with the axis of the largest diameter of each ramp making an angle $\alpha$ with the axis A and the angle $\alpha$ being 90° different.

The ramps 8 and 11 can also not be in a complementary shape, for example ramp 8 can have an oval shape and ramp 11 a sinusoidal shape.

In addition, the projecting ring 12 and groove 15 can be replaced by a fixing system located on the top of the push-button 3; with said fixing system permitting the rotation of the cap 5 relative said push-button 3. Said fixing system is capable of ensuring the guiding in rotation of the cap 5 relative to the push-button 3, the interdependency of the cap 5 and the push-button 3 during a translation of the cap 5 toward the container 2 and enabling the cap 5 to be removed from the device, for example for filling the container 2.

For example, the neck 7 may include threading and the ring 10 can be capable of being screwed on the neck 7.

To dispense a pasty product such as cream, one can for example replace the three converging channels with a single channel. In this case, there is no eruption of particles and the device can make it possible to dispense a dollop of product. In general, the dispensing member and the discharge channel can be any type and shape to permit dispensing the product in different forms.

The invention is not limited to the realization methods described above. It applies to all types of liquid or pasty product dispensing, independent of the specific form of the product jet delivered since it includes the actuation device through cooperation of ramps respectively interdependent of the cap and of the container.

The invention claimed is:

1. A product dispensing device comprising a dispensing member (4) attached to a container (2) with a sealing ring (10), with said container (2) including a neck (7), said dispensing member (4) having mounted thereon a push-button (3) capable of being depressed to operate said dispensing member (4), said push-button including a dispensing orifice (14) permitting the ejection of a product when said dispensing member (4) is operated, and a cap (5), integral to said push-button (3) during a translation about a median axis of the dispensing device toward said container (2), wherein said cap (5) further comprises an interior-projecting ring (12) and said push-button (3) further comprises an annular groove (15), and an interior radial edge of said interior-projecting ring (12) is positioned in said annular groove (15) wherein an edge of said neck (7) includes a ramp (8), one edge of the cap (5) includes a second ramp (11), wherein the ramp (8) and said second ramp (11) are rotatable around each other between a dispensing position in which the dispensing member (4) can be actuated and a locked position in which the actuation of said dispensing member (4) is prevented.

2. The product dispensing device according to claim 1, wherein the ramp (8) and the second ramp (11) have a complementary shape.

3. The product dispensing device according to claim 2, wherein the ramp (8) and the second ramp (11) have a sinusoidal shape.

4. The product dispensing device according to claim 1, wherein said cap (5) and said push-button (3) are interdependent in translation.

5. The product dispensing device according to claim 1, further comprising a centering ring (24), wherein said centering ring (24) is capable of cooperating with said push-button (3) to guide it, in cooperation with the sealing ring (10), during translation, about a median axis (A) of the dispensing device.

6. The product dispensing device according to claim 5, wherein said centering ring (24) is capable of cooperating with said cap (5) to guide it during translation about the median axis (A) of the dispensing device.

7. The product dispensing device according to claim 5, wherein said centering ring (24) is capable of cooperating with said cap (5) to limit, in cooperation with the said projecting ring (12), the translation of the cap (5) toward the container (2).

8. The product dispensing device according to claim 5, wherein the centering ring (24) and the sealing ring (10) are comprised of a single piece.

9. The product dispensing device according to claim 1, further comprising a discharge tube (17) connecting said dispensing member (4) and said dispensing orifice (14).

* * * * *